US007546888B2

(12) United States Patent
Cruz

(10) Patent No.: US 7,546,888 B2
(45) Date of Patent: Jun. 16, 2009

(54) PERCUSSIVE DRILL BIT

(75) Inventor: Antonio Maria Guimaraes Leite Cruz, Rijswijk (NL)

(73) Assignee: Shell Oil Company, Houston, TX (US)

( * ) Notice: Subject to any disclaimer, the term of this patent is extended or adjusted under 35 U.S.C. 154(b) by 73 days.

(21) Appl. No.: 10/559,909

(22) PCT Filed: Jun. 11, 2004

(86) PCT No.: PCT/EP2004/051094

§ 371 (c)(1),
(2), (4) Date: Dec. 8, 2005

(87) PCT Pub. No.: WO2004/111381

PCT Pub. Date: Dec. 23, 2004

(65) Prior Publication Data

US 2006/0131075 A1 Jun. 22, 2006

(30) Foreign Application Priority Data

Jun. 12, 2003 (EP) ..... 03076824

(51) Int. Cl.
*E21B 10/36* (2006.01)

(52) U.S. Cl. ..... 175/415; 175/414

(58) Field of Classification Search ..... 175/293, 175/389, 414, 415, 381
See application file for complete search history.

(56) References Cited

U.S. PATENT DOCUMENTS

| | | | | |
|---|---|---|---|---|
| 2,998,085 | A * | 8/1961 | Dulaney | 175/100 |
| 3,140,748 | A * | 7/1964 | Engle et al. | 175/426 |
| 3,258,077 | A | 6/1966 | Phipps | 175/389 |
| 3,269,470 | A | 8/1966 | Kelly, Jr. | 175/410 |
| 3,388,756 | A | 6/1968 | Varel et al. | 175/410 |
| 3,709,308 | A | 1/1973 | Rowley et al. | 175/329 |
| 3,788,409 | A * | 1/1974 | Curington | 175/426 |
| 3,955,635 | A | 5/1976 | Skidmore | 175/400 |
| 4,051,912 | A | 10/1977 | White | 175/410 |
| 4,296,825 | A | 10/1981 | Larsson | 175/410 |
| 4,558,753 | A | 12/1985 | Barr | 175/329 |
| 4,607,712 | A * | 8/1986 | Larsson | 175/426 |
| 4,676,324 | A | 6/1987 | Barr et al. | 175/393 |
| 4,716,976 | A | 1/1988 | Isakov | 175/410 |
| 4,823,892 | A | 4/1989 | Fuller | 175/329 |

(Continued)

FOREIGN PATENT DOCUMENTS

DE 4200580 3/1993

(Continued)

*Primary Examiner*—Kenneth Thompson

(57) ABSTRACT

A percussion drill bit for drilling into a subterranean earth formation. The drill bit has a central longitudinal axis and is operable by applying repetitive axial percussive impacts on the drill bit in a direction having a component along the axis and by applying rotary motion about the axis relative to the earth formation. The drill bit is provided with one or more axial cutters for predominantly axially cutting the subterranean earth formation in response to the axial percussive impacts and one or more shear cutters for predominantly shear cutting the subterranean earth formation in response to the rotary motion. There is a first shear cutter of the one or more shear cutters, and one or more of the axial cutters are arranged with respect to the first shear cutter to engage with the subterranean earth formation earlier during a percussive impact than the first shear cutter.

20 Claims, 5 Drawing Sheets

U.S. PATENT DOCUMENTS

| | | | | |
|---|---|---|---|---|
| 4,991,670 | A | 2/1991 | Fuller et al. | 175/329 |
| 5,004,056 | A | 4/1991 | Goikhman et al. | 175/293 |
| 5,025,875 | A | 6/1991 | Witt | 175/393 |
| 5,244,039 | A | 9/1993 | Newton, Jr. et al. | 175/431 |
| 5,460,233 | A | 10/1995 | Meany et al. | 175/428 |
| 5,595,252 | A | 1/1997 | O'Hanlon | 175/57 |
| 5,601,477 | A | 2/1997 | Bunting et al. | 451/59 |
| 5,890,551 | A * | 4/1999 | Liljebrand et al. | 175/418 |
| 5,992,547 | A | 11/1999 | Caraway et al. | 175/385 |
| 6,202,770 | B1 | 3/2001 | Jurewicz et al. | 175/428 |
| 6,253,864 | B1 | 7/2001 | Hall | 175/415 |
| 6,290,002 | B1 | 9/2001 | Comeau et al. | 175/73 |
| 6,527,065 | B1 | 3/2003 | Tibbitts et al. | 175/339 |
| 6,672,406 | B2 | 1/2004 | Beuershausen | 175/57 |
| 6,918,455 | B2 * | 7/2005 | Meyers et al. | 175/420.2 |
| 7,104,344 | B2 * | 9/2006 | Kriesels et al. | 175/57 |
| 2002/0066601 | A1 | 6/2002 | Meiners et al. | 175/431 |
| 2005/0269139 | A1 | 12/2005 | Shen et al. | 175/430 |
| 2006/0249309 | A1 | 11/2006 | Cruz | 175/57 |

FOREIGN PATENT DOCUMENTS

| | | |
|---|---|---|
| EP | 0563561 | 10/1993 |
| WO | 01/33031 | 5/2001 |
| WO | 02/099242 | 12/2002 |
| WO | 03/004249 | 1/2003 |
| WO | 03/031763 | 4/2003 |
| WO | 03/042492 | 5/2003 |
| WO | 2004/104362 A1 | 2/2004 |
| WO | 2004/104363 | 2/2004 |
| WO | WO2004111381 | 12/2004 |

* cited by examiner

PERCUSSIVE DRILL BIT

The present application claims priority of European Patent Application No. 03076824.6 filed 12 Jun. 2003.

FIELD OF THE INVENTION

The present invention relates to a percussion drill bit for drilling into a subterranean earth formation, the drill bit having a central longitudinal axis and being operable by applying repetitive axial percussive impacts in a direction having a component along the axis and rotary motion about the axis relative to the subterranean earth formation.

The invention further relates to a drilling system for drilling a borehole in an earth formation, comprising a drill string provided with such a percussion drill bit, and to a method of drilling a bore hole into a subterranean earth formation.

BACKGROUND OF THE INVENTION

The invention also relates to a method of drilling a bore hole into a subterranean earth formation.

A percussive shearing drill bit is known and described in U.S. Pat. No. 6,253,864. FIG. 9 of said U.S. Patent depicts a percussive drill bit having dome shaped axial cutters optimised for percussive penetration of the earth formation, and shear cutters optimised for shear penetration.

In operation, the known percussive shearing drill bit is rotated about its longitudinal axis shearing off the rock formation as the drill bit rotates. A hammer simultaneously impacts the bit thereby providing an additional percussive drilling force.

It is seen as a disadvantage of the known percussive shearing drill bit that, notwithstanding the presence of axial cutters, the shear cutters still are subject to impact blows that may shorten their lifetime and consequently that of the drill bit.

SUMMARY OF THE INVENTION

According to the invention there is provided a percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising

- one or more axial cutters for predominantly axially cutting the subterranean earth formation in response to the axial percussive impacts;
- one or more shear cutters for predominantly shear cutting the subterranean earth formation in response to the rotary motion; whereby
- there is a first shear cutter of the one or more shear cutters, and whereby one or more of the axial cutters are arranged with respect to at least the first shear cutter to engage with the subterranean earth formation earlier during a percussive impact and/or deeper into the earth formation than at least the first shear cutter.

The drill bit according to the invention comprises axial cutters in addition to the shear cutters. The primary function of the axial cutters is suitably to receive the percussive impacts between the drill bit and the earth formation, whereas the primary function of the shear cutters is suitably to scrape off cutting debris from the bottom of the bore hole.

Since the axial cutters are arranged to engage with the earth formation during the percussive impacts before at least said first shear cutter, the most intense part of the axial impacts accompanying the percussive motion is taken by the axial cutting elements. The percussive load on at least said first shear cutter is thereby reduced and consequently its operational lifetime is thereby improved. Thus the axial cutters effectively protect the shear cutter.

Alternatively, the axial cutters are arranged to penetrate the earth formation during the percussive impacts more than at least said first shear cutter.

Since the operational lifetime of the drill bit in accordance with the prior art was limited by the operational lifetime of the shear cutters, improvement of the operational lifetime of the shear cutters results in an improvement of the operation lifetime of the drill bit.

The effectiveness of the shear cutters is maintained at the same time, since the shear cutters are still arranged to engage with the earth formation towards the end of a percussive impact. Thus, the shear cutters become effective in response to rotary motion of the drill bit during which they scrape of cutting debris from the bottom of the bore hole.

As an additional advantage, the axial cutters can be optimized for axial cutting action, whereas the shearing cutters can independently be optimized for shear cutting without having to take into account axial cutting capability.

An advantageous way to arrange the axial cutters with respect to at least the first shear cutter to engage with the subterranean earth formation earlier in a percussive movement than at least the first shear cutter, is an arrangement whereby the one or more axial cutters are arranged with respect to the first shear cutter to penetrate on average deeper into the earth formation than the first shear cutter in each percussive movement. This way, the axial cutters effectively pre-crush the rock and the bit is slowed down in the percussive movement at the same time.

The amount of deeper penetration that is desired depends on the hardness and type of the earth formation in which the bore hole is being drilled. The harder the rock, the higher is preferably the amount of penetration of the axial cutters relative to that of the first shear cutter. Preferably, the one or more axial cutters on average penetrate at least 1.5 times deeper into the earth formation than the first shear cutter in each percussive movement, more preferably at least 2 times deeper. This is found to be suitable for very hard formations including granite containing formations and black gneiss containing formations.

An advantageous way to arrange the axial cutters with respect to at least the first shear cutter to engage with the subterranean earth formation earlier in a percussive movement than at least the first shear cutter, is an arrangement whereby the one or more axial cutters and the first shear cutter each have an impact point, defined as the part of the cutter that serves to firstly engage with the earth formation on an axial percussive movement, whereby at least the impact point of the first shear cutter is recessed by an amount of r in respect of the impact points of the one or more axial cutters. By simply recessing the shear cutter with respect to the one or more axial cutters, the latter will first engage the rock and thereby protect the shear cutter from the most intense part of the percussive impact.

The first shear cutter is preferably protected by one or more axial cutters in relatively close vicinity of the first shear cutter, preferably by neighbouring axial cutters.

In a preferred embodiment, the first shear cutter is arranged in a first annular track about the central axis, the first annular track having a radial width corresponding to the radial width of the first shear cutter, and the one or more axial cutters are arranged in the first annular track. In this embodiment, the first shear cutter is optimally protected, since these axial cutters crush the rock in the same area as the fist shear cutter becomes effective after rotation of the drill bit.

There can be a second shear cutter arranged in a second annular track about the central axis, the second annular track having a radial width corresponding to the radial width of the second shear cutter, whereby one or more axial cutters are arranged in the second annular track. In order to achieve a constant rate of penetration of the drill bit in both tracks, the amount of rock that is to be removed per cutter in each track can vary from track to track depending on the area covered by the track and the number of cutters in the track concerned. In particular in such cases, it is preferred that the impact point of the second shear cutter is recessed in respect of the impact points of the one or more axial cutters in the second annular track by an amount larger than r.

The number of axial cutters in relation to the number of shear cutters can be optimal in dependence of the type of earth formation to be drilled. Earth formations containing relatively hard rock, such as granite, can be drilled with relatively fewer shear cutters and greater total number of cutters, thereby distributing the percussive impact over a larger number of axial cutters.

A softer formation, such as a lime stone or a sand stone, is best drilled using a bit having relatively many shear cutters because impact forces are lower and the chance of bit balling is higher.

An embodiment wherein there are more axial cutters provided than shearing cutters is preferred for drilling harder earth formations.

In an advantageous embodiment, one or more of the shear cutters is provided with a pre-cut flat impact surface essentially parallel to the plane perpendicular to the longitudinal axis. Even though there are provided axial cutters for taking the axial percussive force, the shear cutters also take part of the impact. Due to the pre-cut flat impact surface, the impact stress concentration on the shear cutters is reduced and as a result they do not break as soon as shear cutters that do not have a pre-cut flat impact surface. A natural wear flat has been found not to be sufficiently flat to effectively reduce the impact stress concentration, because during percussive operation of the drill bit the shear cutters tend to break in a rough fashion rather than form an effective wear flat.

In an advantageous embodiment, the percussion drill bit further comprises:

a plurality of blades protruding from the drill bit;

a plurality of flow channels stretching along the drill bit in a substantially radial direction whereby the successive flow channels are formed between two adjacent blades;

the shear cutters being provided in rows on the leading edges of the blades with respect to the direction of rotary motion whereby each row of shear cutters has a flow channel associated with it for running a fluid through and thereby removing cutting debris accumulating in front of each row of shear cutters.

Herewith, so called bit balling, whereby rock flour and rock chips ploughed in front of the shear cutters mix with drilling fluid such as water, oil or mud to form a paste in the bottom of the bore hole is avoided, because the substantially radial flow channel is fully effective in removing cutting debris accumulating in front of the row of shear cutters. Bit balling is undesired, since the resulting paste takes the weight of the bit instead of the underlying rock.

Bit balling is even better avoided in an embodiment where the axial cutters are provided with respect to the direction of rotary motion in a trailing position behind each row of shear cutters and ahead of the subsequent neighbouring flow channel that is associated with the next row of shear cutters of the next blade. Any bit balls formed under the axial cutters will end up in the trailing flow channel.

The invention also provides a drilling system for drilling a borehole in an earth formation, comprising a drill string provided with a percussion drill bit according to one or more of the embodiments described above, the drilling system further comprising:

first drive means for rotating the drill bit in the borehole so as to induce a scraping movement of the shear cutters along the borehole bottom; and second drive means for inducing repetitive axial percussive impacts on the drill bit in a direction having a component along the axis of the drill bit in the borehole so as to induce at least the axial cutters to exert a percussive force to the borehole bottom.

The drill bit or drilling system provided with shear cutters having the pre-cut flat impact surface has been found to cause fewer stick-slip torsional vibration modes in the drilling system, whereby the bit is hammered to a standstill into the earth formation while the drill string is twisted by the surface rotary drive until it abruptly releases with relatively high rotational speed. Such a stick-slip torsional vibration repeats periodically and the high rotational speed associated with the stick-slip torsional vibration can severely damage the cutters on the drill bit.

The method of the invention comprises the steps of providing a drilling system in accordance with one of the above defined embodiments, placing the drill bit against the subterranean earth formation that is to be drilled, exercising a rotary motion about the axis while maintaining a force on the drill bit against the earth formation in the axial direction, and intermittingly providing percussive strikes on the drill bit.

Since the drill bit has an improved operational lifetime, it does not have to be replaced as often as before so that the method of the invention requires fewer trips per bore hole to be drilled.

BRIEF DESCRIPTION OF THE DRAWINGS

The invention will now be illustrated by way of example, with reference to the accompanying drawing wherein.

DETAILED DESCRIPTION OF THE INVENTION

Figure 1A:
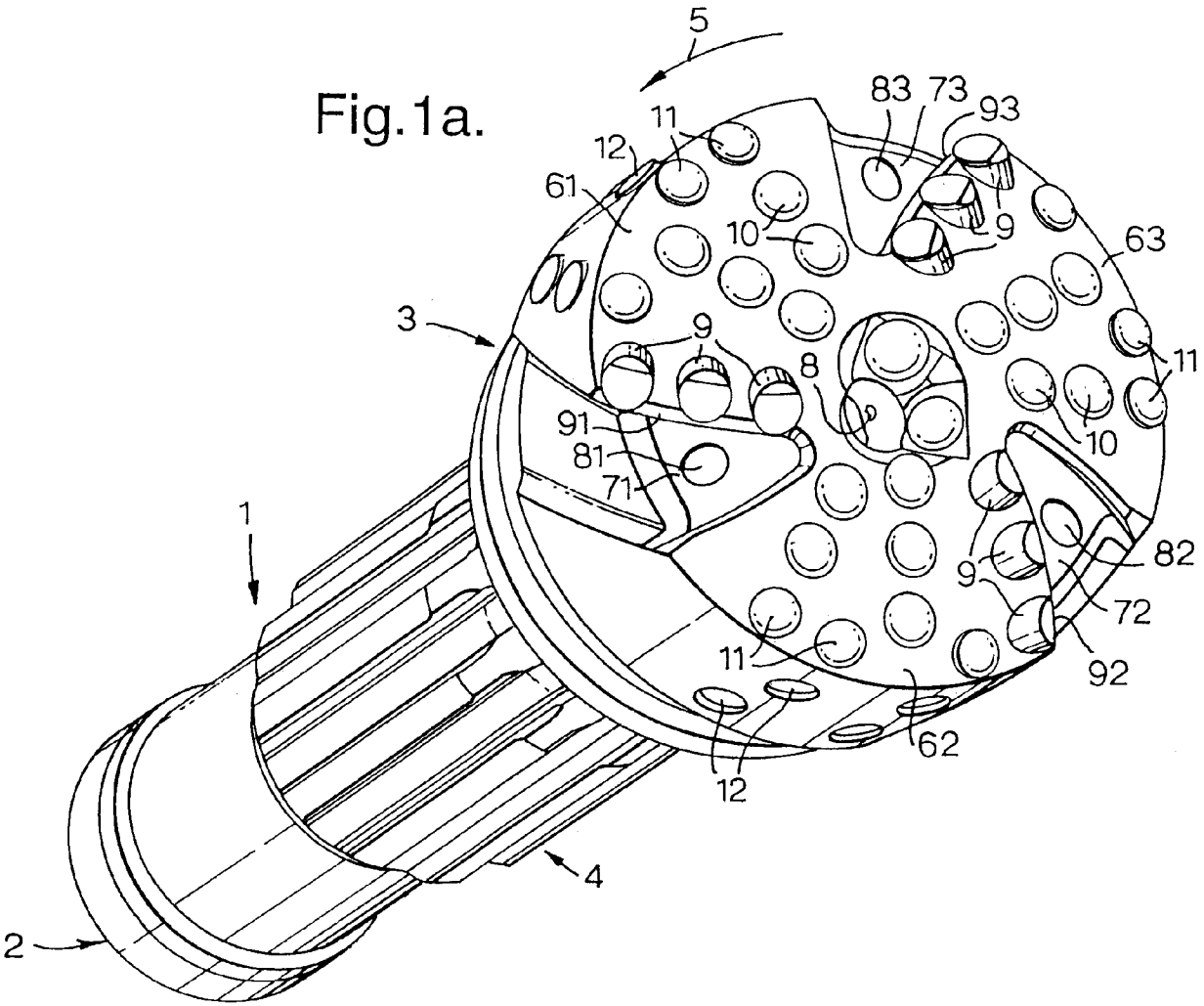
FIG. 1*a* shows a perspective view of an embodiment of a 6" 3-blade percussion drill bit in accordance with the invention.

In the figures, like parts carry identical reference numerals.

A perspective view of a 3-blade percussion drill bit in accordance with an embodiment of the invention is shown in FIG. 1*a*. The drill bit comprises a shank 1 stretching longitudinally about a central longitudinal axis of the drill bit, which shank can be especially adapted to fit inside a drill string. The rearward end of the shank is connected to a striking surface 2 to receive impacts from a percussive hammer, preferably a reciprocative piston hammer (not shown). The forward end of the shank is connected to a drilling head 3. The shank 1 is provided with a plurality of splines 4, running essentially longitudinally along the shank 1. The splines 4 serve to rotationally couple the drill string and the shank 1, so that the drill bit is operable by applying both axially directed percussive impacts on the drill bit and rotary motion about the central longitudinal axis.

Figure 1B:
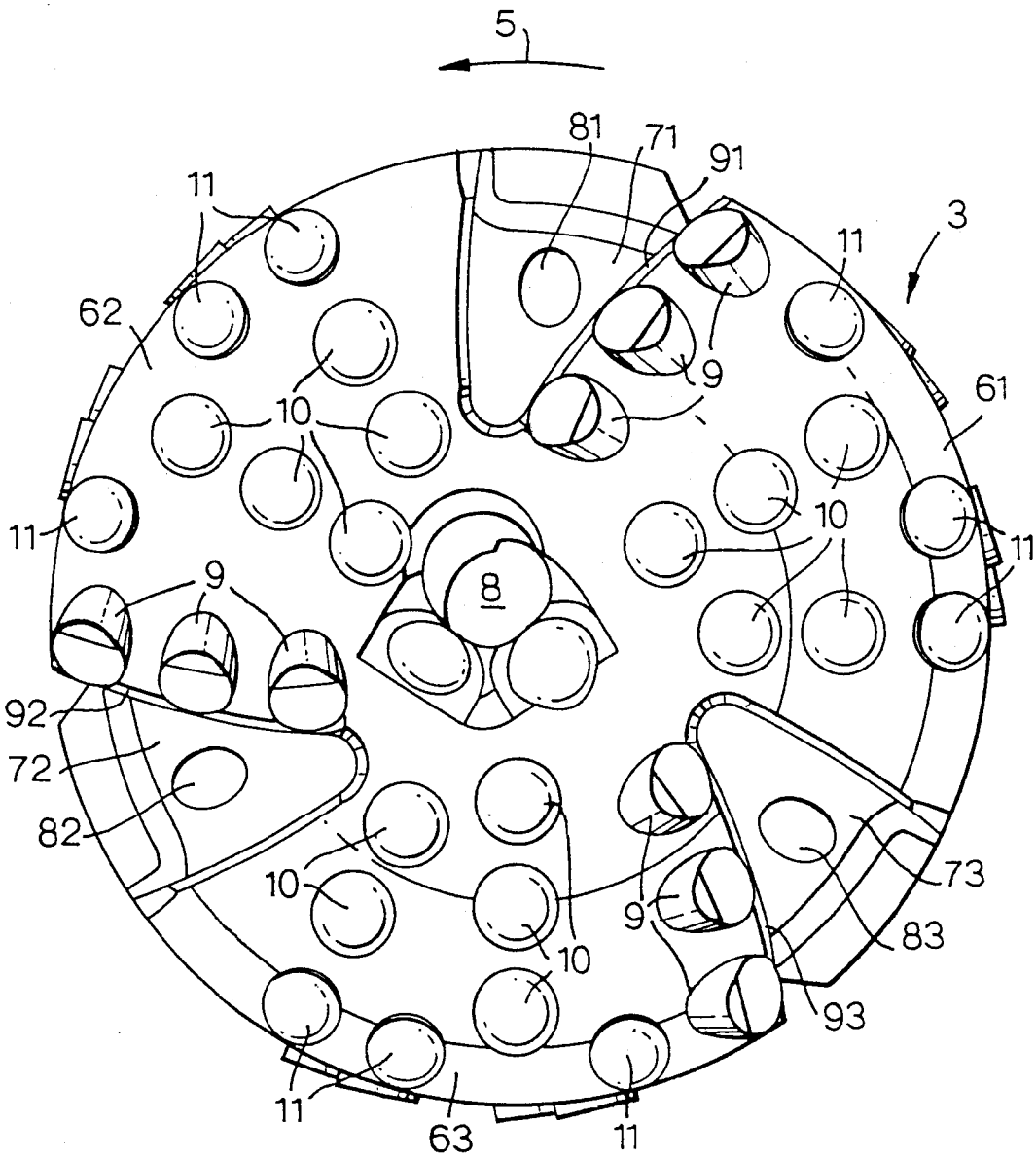
FIG. 1*b* shows a top view of the bit face of the percussion drill bit shown in FIG. 1*a*.

Referring now to FIGS. 1*a* and 1*b*, the drilling head 3 is provided with three blades 61, 62, and 63 that protrude from the drill bit. The areas between the blades 61, 62, 63 are recessed with respect to the blades and thus form flow channels 71, 72, 73. The flow channels 71, 72, 73, essentially run radially along the drilling head 3.

A central passage way 8 is provided in the drilling head 3 for passing of flushing fluid. In addition of or instead of the central passage way 8, passage ways 81, 82, 83, can be provided in the flow channels 71, 72, 73 between the blades 61, 62, 63. The passage ways are all connected to a central longitudinal bore (not shown) running through the shank 1.

In hydro-carbon well drilling operations, the drill string is conventionally rotated in clock-wise direction. Arrows 5 in FIGS. 1*a* and 1*b* depict the direction of rotary motion that, in operation, is applied to the drill bit.

The blades 61, 62, 63 thus each have a leading edge 91, 92, 93, with respect to the direction of rotary motion 5. Shear cutters 9 are provided in a row on the leading edge 91, 92, 93 of each respective blade 61, 62, 63. Each row of shear cutters 9 has a flow channel associated with it directly in front of the row of shear cutters 9 with respect to the direction of rotary motion 5.

Behind each row of shear cutters 9, thus in a trailing position with respect each row of shear cutters 9, axial cutters 10, 11, are provided on the blades 61, 62, 63.

The shear cutters 9 are recessed with respect to the axial cutters 10, 11, such that the axial cutters 10,11 impact on the rock in the bottom of the bore hole during percussive impacts before the shear cutters 9 do. In particular, shear cutters positioned on a certain radial distance from the central longitudinal axis are recessed with respect to the axial cutters that are located on approximately the same radial distance.

Figure 2:
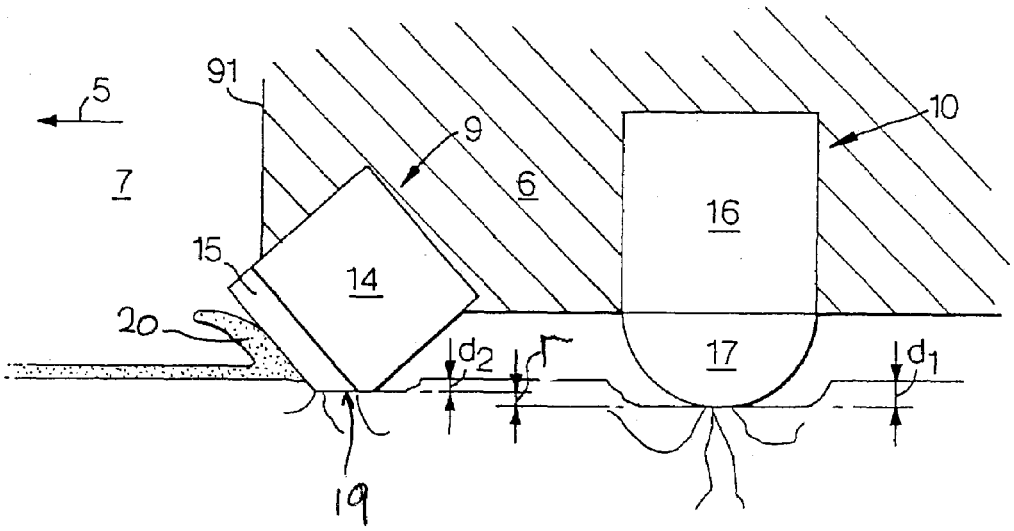
FIG. 2 shows a schematic cross section of the cutter arrangement.

FIG. 2 depicts a schematic representation of the cutter arrangement in accordance with this embodiment of the invention, as seen in a tangential cross section. As in the previous figures, arrow 5 depicts the direction of rotary motion that, in operation, is applied to the drill bit. Visible are one of the blades 6 and its leading edge 91 with respect to the direction of rotary motion, which blade protrudes downwardly from the drill head and accommodates cutters 9 and 10. A shear cutter 9 is provided on or adjacent to the leading edge 91. Behind the shear cutter 9 in relation to the direction of rotary movement 5, is an axial cutter 10.

The shear cutters 9 have a shape optimised for scraping along the bottom of the bore hole and thereby shearing pieces of the earth formation from the bottom of the bore hole. The axial cutters 10, 11, have a shape optimised for axially indenting the earth formation in the bottom of the bore hole and thereby possibly crushing the earth formation.

As a result of the axial percussive impacts, the formation 13 underneath the axial cutter 10 crushes. The axial cutter 10 is depicted to penetrate into the earth formation 13 by a depth d1. The shear cutter 9 is recessed with respect to the axial cutter 10 so that its penetration depth into the earth formation, d2, is less than that of the axial cutter 10 by an amount of r. As a result of the recessed arrangement of the shear cutter 9 with respect to the axial cutter 10, in operation the axial cutter first engages a fresh part of the bore hole bottom on a downward percussive movement of the drill bit. The shear cutter 9 does not engage with the earth formation before the axial cutter 10 has indented the earth formation over a depth r. At this point, the strongest part of the percussive impact has already been received by the axial cutter 10, and therefore the shear cutter 9 undergoes less percussive impact forces than it would have when it would have engaged with the earth formation at the same time as, or earlier than, the axial cutter 10. Herewith the operational lifetime of the cutters is sustained as much as possible.

Towards the end of the percussive impact, the axial cutters 10, 11 and the shear cutters 9 both are in contact with the earth formation 13, so that the shear cutters 9 can efficiently shear-cut the earth formation and scrape off cutting debris 20. As the bit rotates, the shear cutters 9 scrape along the bottom hole surface and build up rock flour and chips from the cutting debris and drilling fluid. The rock flour and chips are pushed in front of the shear cutters 9 where there is preferably a flow channel 7 with flushing fluid running through it in an essentially radially outward direction. From there, the scraped cutting debris is flushed to the bore hole annulus and removed from the bottom hole area.

Figure 3A:
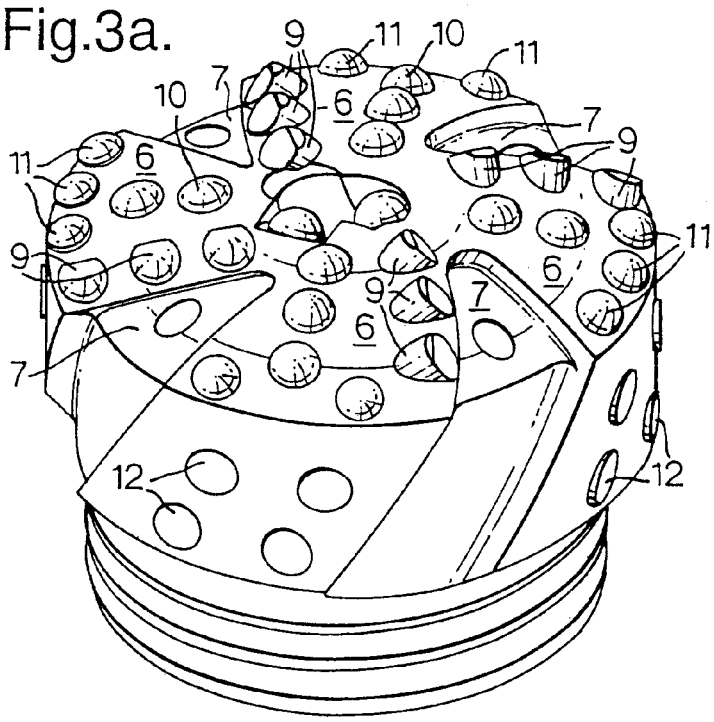
FIG. 3*a* shows a perspective view of a 6" 4-blade percussion drill bit in another embodiment of the invention.
Figure 3B:
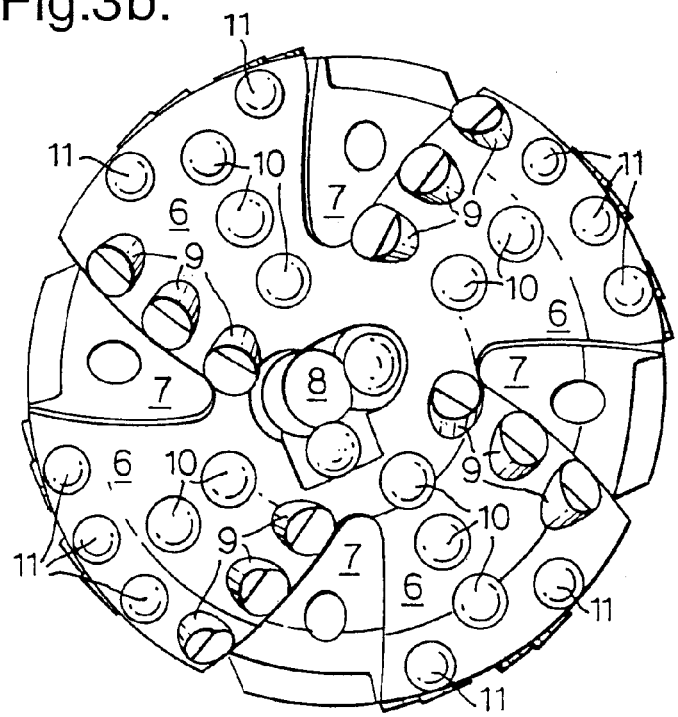
FIG. 3*b* shows a top view of the bit face of the percussion drill bit shown in FIG. 3*a*.

FIG. 3*a* shows a perspective view, and FIG. 3*b* a top view, of a variant of the drill bit providing another embodiment of the invention having four blades 6 and consequently four flow channels 7. In other respects, this variant is similar to the one shown in FIGS. 1*a* and 1*b*. In particular, the recessed arrangement of the shear cutters 9 on the leading edges of the blades with respect to the axial cutters 10, 11 that are in a trailing position with respect to the rows of shear cutters 9, is similar to the first discussed embodiment.

The various concentric dot-dash lines in FIG. 3*b* connect groups of axial cutters and shear cutters that are considered to be positioned on respective tracks. The tracks are numbered tr1 to tr6 starting furthest away from the central axis.

The amount of recessing of the shear cutters preferably varies from track to track, depending on the amount of rock that is removed per cutter in each track.

Generally, close to the gauge of the bit (corresponding to lower track numbers) the cutters have to remove more formation per cutter since the area of each track increases with distance from the central axis whereas the number of cutters present in that track in many bit designs does not increase in the same amount. For this reason, on average over time, the outer cutters undergo more rock penetration than the cutters closer to the central axis of the bit. The recessing of the shear cutters can be increased accordingly, so that the time-averaged penetration of the shear cutters is the same in each track either in absolute value of d1 or relative to d2, whichever is desired.

Figure 4:
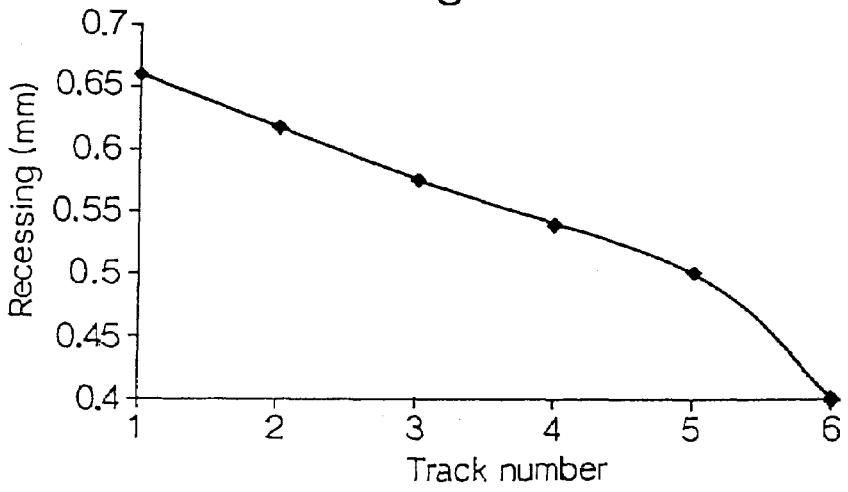
FIG. 4 is a graph showing recessing variation over consecutive tracks on a 6" bit face.

A typical recessing distribution for the 6" bit shown in FIG. 3 is depicted in FIG. 4, for a case where the rate of penetration is to be 12 m/hr, and the percussive frequency is 25 Hz. The shear cutters in the outer most track, having track number 1, are recessed by 0.66 mm versus 0.40 mm in the sixth track.

In general, this distribution of recess values over the tracks can be based on average axial cutter penetration estimates, made in the following way. For a specified rate of penetration of the drill bit, the quantity of rock to be removed in each track is known.

Since the number of axial cutters is known, the amount of removed rock per axial cutter is also known. It is thereby assumed that most rock is removed by the percussive impacts which has a known frequency.

The diameter of the outer periphery of the percussion drill bits discussed above in FIGS. 1*a* and 1*b*, and FIGS. 3*a* and 3*b*, is 6", corresponding to approximately 15 cm. An example of an 8" (corresponding to approximately 20 cm outer diameter) bit face is depicted in FIG. 5.

Figure 5:
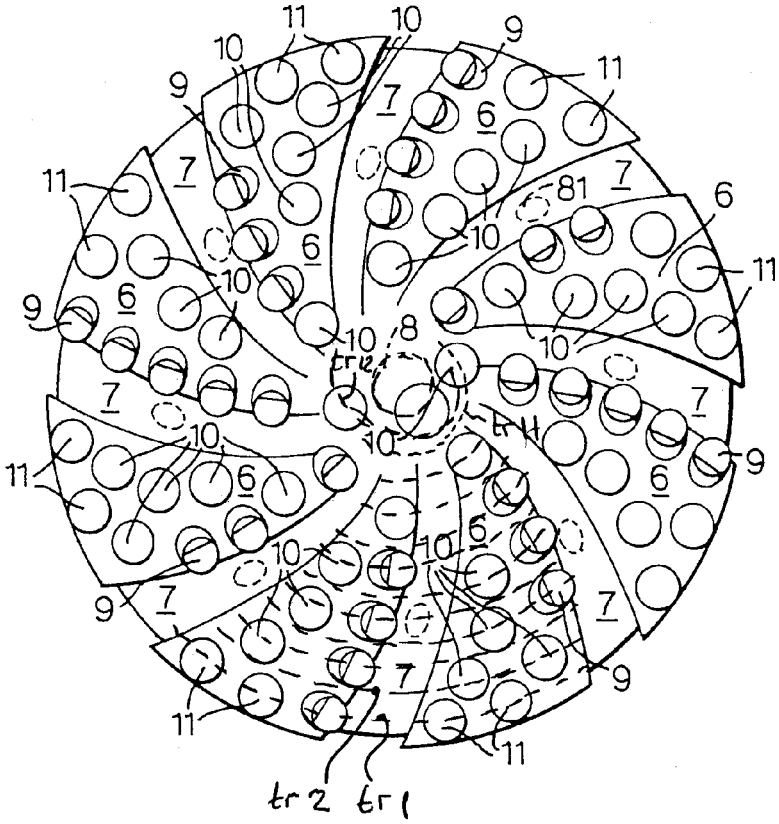
FIG. 5 shows a top view of an 8" bit face according to still another embodiment of the invention, having 8 blades.

The various concentric dot-dash lines in FIG. 5 connect groups of axial cutters and shear cutters that are considered to be positioned on respective tracks.

The embodiment shown in FIG. 5 is based on eight blades 6 and a corresponding number of flow channels 7. Each flow channel 7 is provided with a passage way 81 for allowing entry of flushing fluid into the respective flow channel. Since this bit face of FIG. 5 has a larger diameter than the ones shown in FIGS. 2 and 3, a larger number of shear cutters 9 and axial cutters 10, 11 can be accommodated.

In the above described percussion drill bits depicted in FIGS. 3*a* and 3*b* and FIG. 5, the shear cutters in a first said row of shear cutters are positioned at mutually different radial positions than the shear cutters in a second said row of shear cutters on another blade. This way, the gaps left between adjacent shear cutters in one row are covered by the shear cutters in a next row on a different blade when the drill bit is rotated. Ideally, the circular paths of the collection of shear cutters slightly overlap such that a continuous band of shear cutting is achieved over a majority of the area in the bore hole bottom surface.

In the above shown embodiments, the axial cutters 10 are each formed of an axial cutter shank 16 which at least on one side is provided with a hemispherical or dome shaped cutting surface 17. The cutter is made of a hard material, for which tungsten carbide is a suitable material. Optionally, the cutter can be provided with a layer of polycrystalline diamond thus forming a PDC axial cutter.

In the examples shown in FIGS. 1*a* and 1*b*, FIGS. 3*a* and 3*b*, and FIG. 5, the outermost axial cutters 11 are PDC axial cutters and the other axial cutters 10 are tungsten carbide axial cutters. Thus, in these bit faces the outer most axial cutters 11 are harder than the remaining axial cutters 10.

The shear cutters 9 shown above are PDC cutters having a shear cutter shank 14 made of a hard material, for which tungsten carbide is suitable. The rake surface facing the associated flow channel 71, is covered with a layer 15 of polycrystalline diamond. Such a shear cutter having a polycrystalline diamond cutting surface is known as a polycrystalline diamond compact cutter, or PDC cutter. In addition to the rake surface, the shear cutter is provided with a pre-cut flat impact surface stretching essentially perpendicular to the central longitudinal axis of the drill bit and essentially parallel to the bottom hole surface of the earth formation 13.

In order to reduce the impact stress concentration acting on the shear cutters, the shear cutters 9 in the above described examples are provided with a pre-cut impact surface. These pre-cut impact surfaces, which can be viewed upon as pre-cut wear flats, are also beneficial in reducing the tendency to excite so-called slip-stick torsional vibrations in the drilling system.

Figure 6:
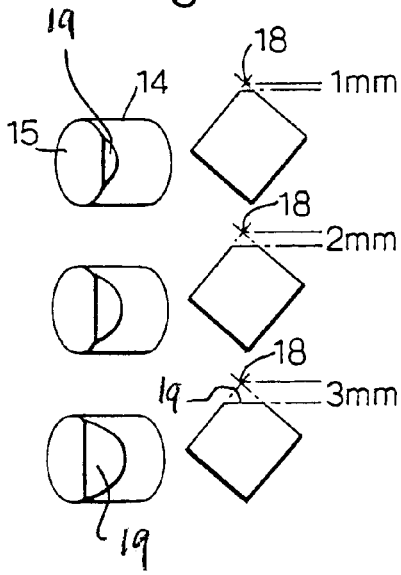
FIG. 6 schematically shows different shear cutters having pre-cut flat impact surfaces.

FIG. 6 schematically shows the provision of the pre-cut flat impact surface 19 on these shear cutters for different pre-cutting depths of 1 mm, 2 mm and 3 mm. The pre-cutting depth corresponds to the normal distance between the pre-cut impact surface 19 and the summit point 18 where the shear cutter shank outer shell and the rake surface come together. The back-rake angle of each of these shear cutters is 40° as an example, but any angle smaller than 90° can be applied. The impact surface has an impact surface back-rake angle that is greater than the rake surface back-rake angle. The best result is obtained when the impact surface back-rake angle is essentially 90°.

It can be seen that the pre-cut flat impact surface 19 area increases as the pre-cutting depth increases. Preferably, the pre-cutting depth is between 1 and 3 mm.

In operation, the percussion drill bit is incorporated in a drilling system whereby the percussion drill bit is held by a drill string. The drilling system further comprises:

first drive means for rotating the drill bit in the borehole so as to induce a scraping movement of the shear cutters along the borehole bottom; and second drive means for inducing a longitudinal reciprocal movement of the drill bit in the borehole so as to induce at least the axial cutters to exert a percussive force to the borehole bottom, which first and second drive means are both operated simultaneously. The second drive means are preferably formed by a hammer, more preferably a reciprocative piston hammer. During a drilling operation, a drilling fluid is pumped through the drill string which is in fluid connection with the passages 8, 81, 82, 83. Suitable drilling fluids are mud, water, oil or foam, and can vary in dependence of the type of formation to be drilled.

In order to further assist the flushing of cutting debris though the flow channels, the rake surface of each shear cutter can have a secondary inclination relative to the radial direction of the drill bit, the secondary inclination being such that the rake surface pushes drill cuttings from the rock formation in radially outward or radially inward direction.

Typical suitable operating conditions for the drill bits described above, include a weight on bit lying in a range between 3 to 6 metric tons. The amount of percussive energy exercised on the drill bit per percussive blow can lie in a range of between 0.3 kJ to 5 kJ. Typically, the drilling system can be operated using between 10 and 50 kW of percussive power, at a percussion frequency between 9 and 30 Hz.

Field Trial 1

Using a drill bit with a cutter pattern corresponding to the cutter pattern depicted in FIG. 5, a bore hole was percussively drilled at a depth of 3.6 km through black gneiss, which is a very hard and abrasive rock. Counting radially inwards, the lay out of the drill bit is summarised in the following table, whereby tracks tr1 to tr13 correspond to the circular tracks of which sections are given in FIG. 5 as dashed circle sections.

| Track ID | Shear PCD | Carbide dome | PDC dome | Recess r |
|---|---|---|---|---|
| tr1 | 4 | 0 | 16 | 0 |
| tr2 | 4 | 0 | 4 | 0 |
| tr3 | 4 | 4 | 0 | 0 |
| tr4 | 4 | 4 | 0 | 0 |
| tr5 | 4 | 4 | 0 | 0 |
| tr6 | 4 | 4 | 0 | 0.25 mm |
| tr7 | 4 | 4 | 0 | 0.50 mm |
| tr8 | 2 | 2 | 0 | 0 |
| tr9 | 2 | 2 | 0 | 0 |
| tr10 | 2 | 2 | 0 | 0 |
| tr11 | 0 | 1 | 0 | n.a. |
| tr12 | 0 | 1 | 0 | n.a. |
| tr13 | 0 | 0 | 1 | n.a. |

The shear cutters in tracks 1 to 5 and 8 to 10 were not recessed with respect to the axial cutters in these tracks. The shear cutters in track 6 were recessed by r=0.25 mm with respect to the axial cutters in that track. The shear cutters in track 7 were recessed by r=0.50 mm with respect to the axial cutters in that track.

After two hours of drilling, the shear cutters in track 7 were largely undamaged, while they were heavily damaged in the remaining tracks. The shear cutters in track 6 were less heavily damaged than those in the remaining tracks, but in worse condition than those in track 7.

Surprisingly, not only the shear cutters but also the axial cutters in track 7 were less worn than the axial cutters in the other tracks.

The percussion drill bits shown and described above have 6" and 8" outer diameters by way of example. It will be understood that other diameters can be applied in a similar fashion. Likewise, the invention is not limited by the number of blades shown. Any number of blades can be provided.

I claim:

1. A percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising:

a drilling head;

one or more axial cutters for predominantly axially cutting the subterranean earth formation in response to the axial percussive impacts;

one or more shear cutters for predominantly shear cutting the subterranean earth formation in response to the rotary motion;

wherein said axial cutters and said shear cutters are mounted on said drilling head and do not move relative to each other;

wherein there is a first shear cutter of the one or more shear cutters, wherein both of said axial and said shear cutters receive percussive impact and wherein one or more of the axial cutters are arranged with respect to at least the first shear cutter to engage the subterranean earth formation earlier during a percussive impact than at least the first shear cutter.

2. The percussion drill bit of claim 1, wherein the axial cutters have dome shaped or essentially hemispherical shaped cutting surfaces.

3. The percussion drill bit of claim 1, wherein one or more of the shear cutters is provided with a pre-cut flat impact surface essentially parallel to the plane perpendicular to the central longitudinal axis.

4. The percussion drill bit of claim 1, wherein the ratio between the number of axial cutters and the number of shearing cutters provided is at least 3:2.

5. The percussion drill bit of claim 1, wherein the one or more axial cutters are arranged with respect to the first shear cutter to penetrate on average at least 1.5 times deeper into the earth formation than the first shear cutter in each percussive movement.

6. The percussion drill bit of claim 1, wherein the one or more axial cutters are arranged with respect to the first shear cutter to penetrate on average at least 2 times deeper into the earth formation than the first shear cutter in each percussive movement.

7. The percussion drill bit of claim 1, wherein the one or more axial cutters are arranged with respect to the first shear cutter to penetrate on average deeper into the earth formation than the first shear cutter in each percussive movement.

8. The percussion drill bit of claim 7, wherein the first shear cutter is arranged in a first annular track about the central axis, the first annular track having a radial width corresponding to the radial width of the first shear cutter, whereby the one or more axial cutters are arranged in the first annular track.

9. The percussion drill bit of claim 7, wherein one or more of the shear cutters is provided with a pre-cut flat impact surface essentially parallel to the plane perpendicular to the central longitudinal axis.

10. A percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising:

one or more axial cutters for predominantly axially cutting the subterranean earth formation in response to the axial percussive impacts; and one or more shear cutters for predominantly shear cutting the subterranean earth formation in response to the rotary motion;

wherein there is a first shear cutter of the one or more shear cutters, and wherein one or more of the axial cutters are arranged with respect to at least the first shear cutter to engage the subterranean earth formation earlier during a percussive impact than at least the first shear cutter; and wherein the first shear cutter is arranged in a first annular track about the central axis, the first annular track having a radial width corresponding to the radial width of the first shear cutter, whereby the one or more axial cutters are arranged in the first annular track.

11. The percussion drill bit of claim 10, wherein there is a second shear cutter arranged in a second annular track about the central axis, the second annular track having a radial width corresponding to the radial width of the second shear cutter, whereby one or more axial cutters are arranged in the second annular track, whereby the impact point of the second shear cutter is recessed in respect of the impact points of the one or more axial cutters in the second annular track by an amount larger than r.

12. The percussion drill bit of claim 11, whereby the second annular track is radially further outward with respect to the central axis than the first annular track.

13. A percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising:

one or more axial cutters for predominantly axially cutting the subterranean earth formation in response to the axial percussive impacts;

one or more shear cutters for predominantly shear cutting the subterranean earth formation in response to the rotary motion;

wherein there is a first shear cutter of the one or more shear cutters, and wherein one or more of the axial cutters are arranged with respect to at least the first shear cutter to engage the subterranean earth formation earlier during a percussive impact than at least the first shear cutter; and wherein the one or more axial cutters and the first shear cutter each have an impact point, defined as the part of the cutter that serves to firstly engage with the earth formation on an axial percussive impact, whereby at least the impact point of the first shear cutter is recessed by an amount of r in respect of the impact points of the one or more axial cutters.

14. The percussion drill bit of claim 13, wherein r>0.25 mm.

15. The percussion drill bit of claim 13, wherein r>0.50 mm.

16. A percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising:

one or more axial cutters for predominantly axially cutting the subterranean earth formation in response to the axial percussive impacts;

one or more shear cutters for predominantly shear cutting the subterranean earth formation in response to the rotary motion;

wherein there is a first shear cutter of the one or more shear cutters, and wherein one or more of the axial cutters are arranged with respect to at least the first shear cutter to engage the subterranean earth formation earlier during a percussive impact than at least the first shear cutter; and wherein the shear cutters have a rake surface facing the flow channel associated with it at a back-rake angle of less than 90° wherein the back-rake angle is defined as the angle between the projection of a line perpendicular to said rake surface on a plane defined by said central longitudinal axis of the drill bit and the tangential direction of rotary motion, and a plane perpendicular to said longitudinal axis.

17. A percussion drill bit for drilling into a subterranean earth formation, the drill bit having a central longitudinal axis and being operable by applying repetitive axial percussive impacts on the drill bit in a direction having a component along the axis and by applying rotary motion about the axis relative to the earth formation, the drill bit comprising:

one or more axial cutters for predominantly axially cutting the subterranean earth formation in response to the axial percussive impacts;

one or more shear cutters for predominantly shear cutting the subterranean earth formation in response to the rotary motion;

a plurality of blades protruding from the drill bit; and a plurality of flow channels stretching along the drill bit in a substantially radial direction whereby the successive flow channels are formed between two adjacent blades;

wherein the shear cutters are provided in rows on the leading edges of the blades with respect to the direction of rotary motion such that each row of shear cutters has a flow channel associated with it for running a fluid through and thereby removing cutting debris accumulating in front of each row of shear cutters; and wherein there is a first shear cutter of the one or more shear cutters, and wherein one or more of the axial cutters are arranged with respect to at least the first shear cutter to engage the subterranean earth formation earlier during a percussive impact than at least the first shear cutter.

18. The percussion drill bit of claim 17, wherein the axial cutters are provided with respect to the direction of rotary motion in a trailing position behind each row of shear cutters and ahead of the subsequent neighbouring flow channel that is associated with the next row of shear cutters of the next blade.

19. A drilling system for drilling a borehole in an earth formation, comprising a drill string provided with a percussion drill bit having a central longitudinal axis and being operable by applying repetitive axial percussive impacts on the drill bit in a direction having a component along the axis and by applying rotary motion about the axis relative to the earth formation, the drill bit comprising:

a drilling head;

one or more axial cutters for predominantly axially cutting the subterranean earth formation in response to the axial percussive impacts;

one or more shear cutters for predominantly shear cutting the subterranean earth formation in response to the rotary motion;

wherein said axial cutters and said shear cutters are mounted on said drilling head and do not move relative to each other; and wherein there is a first shear cutter of the one or more shear cutters, wherein both of said axial and said shear cutters receive percussive impact, and wherein one or more of the axial cutters are arranged with respect to at least the first shear cutter to engage with the subterranean earth formation earlier during a percussive impact than at least the first shear cutter, the drilling system further comprising:

first drive means for rotating the drill bit in the borehole so as to induce a scraping movement of the shear cutters along the borehole bottom; and second drive means for inducing repetitive axial percussive impacts on the drill bit in a direction having a component along the axis of the drill bit in the borehole so as to induce at least the axial cutters to exert a percussive force to the borehole bottom.

20. A method of drilling a bore hole into a subterranean earth formation, comprising the steps of:

providing a drilling system for drilling a borehole in an earth formation, comprising a drill string provided with a percussion drill bit having a central longitudinal axis and being operable by applying repetitive axial percussive impacts on the drill bit in a direction having a component along the axis and by applying rotary motion about the axis relative to the earth formation, the drill bit comprising:

a drilling head;

one or more axial cutters for predominantly axially cutting the subterranean earth formation in response to the axial percussive impacts;

one or more shear cutters for predominantly shear cutting the subterranean earth formation in response to the rotary motion;

wherein said axial cutters and said shear cutters are mounted on said drilling head and do not move relative to each other; and wherein there is a first shear cutter of the one or more shear cutters, wherein both of said axial and said shear cutters receive percussive impact, and wherein one or more of the axial cutters are arranged with respect to at least the first shear cutter to engage with the subterranean earth formation earlier during a percussive impact than at least the first shear cutter, the drilling system further comprising:

first drive means for rotating the drill bit in the borehole so as to induce a scraping movement of the shear cutters along the borehole bottom; and second drive means for inducing repetitive axial percussive impacts on the drill bit in a direction having a component along the axis of the drill bit in the borehole so as to induce at least the axial cutters to exert a percussive force to the borehole bottom, placing the drill bit against the subterranean earth formation that is to be drilled, exercising a rotary motion about the axis while maintaining a force on the drill bit against the earth formation in the axial direction, and intermittingly providing percussive strikes on the drill bit.

* * * * *